United States Patent [19]

Cannarsa

[11] Patent Number: 4,641,474

[45] Date of Patent: Feb. 10, 1987

[54] STA-PUT WALLBOARD JOINER

[76] Inventor: Robert C. Cannarsa, 21 Townsend St., Glen Head, N.Y. 11545

[21] Appl. No.: 774,703

[22] Filed: Sep. 11, 1985

[51] Int. Cl.[4] ..... E02D 37/00; E02G 23/00

[52] U.S. Cl. ..... 52/514; 52/361; 52/714; 411/461; 411/466

[58] Field of Search ..... 52/361, 362, 363, 712, 52/713, 714, 715, DIG. 6, 514; 411/458, 461, 466

[56] References Cited

U.S. PATENT DOCUMENTS

| | | | |
|---|---|---|---|
| D. 136,373 | 9/1943 | Boyles | 52/DIG. 6 |
| 1,373,036 | 3/1921 | Upson | 411/466 |
| 1,492,469 | 4/1924 | Kangieser | 52/362 |
| 2,283,167 | 5/1942 | Burson | 52/361 X |
| 3,073,421 | 1/1963 | Bock | 52/361 X |
| 3,378,973 | 4/1968 | Tudor-Pole | 52/714 X |
| 4,062,162 | 12/1977 | Nicklaus et al. | 52/714 X |

*Primary Examiner*—Carl D. Friedman
*Assistant Examiner*—Richard Chilcot
*Attorney, Agent, or Firm*—Leonard Belkin

[57] ABSTRACT

A fastener for supporting a section of wallboard inserted into the opening of a wall consisting of a metal clip having a pair of flat segments for engaging adjacent portions of the section and the wall. A V-shaped member connects the two flat segments and spikes are employed on the V-shaped member and the flat segments to effect the attachment.

4 Claims, 4 Drawing Figures

STA-PUT WALLBOARD JOINER

BACKGROUND OF THE INVENTION

This invention relates to a wallboard fastener and more particularly to a wallboard fastener which is capable of holding securely in place a piece or section of wallboard inserted into an opening in a wall constructed of wallboard.

In the repair of a wall constructed of wallboard, also known as drywall, it is often necessary to fill in a hole with a section or a fitted piece of wallboard. When the section is inserted, the piece is taped and then spackled and smoothed down, followed by painting. A difficult problem is that of securing the section in place while it is being taped as there is no convenient and economical way presently available to hold the loose section in place once properly adjusted while the tape is being applied.

SUMMARY OF THE PRESENT INVENTION

The present invention makes it possible to secure a loose section of wallboard in place prior to it being taped and spackled.

A preferred embodiment of this invention consists of a metal clip having a pair of spaced surfaces substantially in the same plane having teeth to penetrate the adjacent surfaces of said section of wallboard and said wall when the former is inserted into said opening, and a V-shaped extension extending into the space between the section and the wall joining the two flat surfaces of the clip. Teeth mounted on the outside of both legs of the V-shaped extension are directed toward the spaced flat surfaces so that when the clip is mounted on the section of wallboard and the latter is then inserted into the opening in the wall the teeth on the clip will resist movement of the section once fully mounted flush with the wall.

It is thus a principal object of this invention to provide a fastener for securing a section of wallboard fitted into an opening in the wall.

Other objects and advantages of this invention will hereinafter become obvious from the following description of preferred embodiments of this invention.

DETAILED DESCRIPTION OF THE PREFERRED EMBODIMENTS

Figure 1:
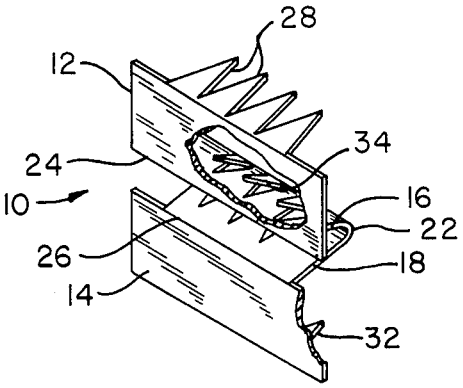
FIG. 1 is an isometric view of a preferred embodiment of this invention broken away in places.

Referring to FIG. 1, fastener 10 is a clip which can be constructed from a single sheet of a suitable metal such as thin gage spring steel to give it the elastic or resilient quality to be described below.

Fastener 10 has a pair of spaced flat segments or surfaces 12 and 14 located in a common plane and joined by a V-shaped section made up of a pair of legs 16 and 18 joined together at 22 and joined to segments 12 and 14 at 24 and 26, respectively.

The free edges of flat segments 12 and 14 are each provided with a row of teeth 28 and 32, respectively, which can be of any suitable shape although they are herein shown as being triangular and coming to a point. Legs 16 and 18 are also each provided with a row of teeth 34 and 36, respectively, which extend outwardly and toward flat segments 12 and 14. Teeth 28 and 32 would be generally at right angles to flat segments 12 and 14.

Fastener 10 can be, as noted, constructed of a single sheet of metal with teeth 34 and 36 punched out of the surfaces of legs 16 and 18, or, if desired, the teeth can be attached by any suitable means such as soldering or brazing. The resiliency of the material insures positive engagement of the teeth with the adjacent portions of the section and wall. By wallboard referred to herein is meant any flat material of construction having the capability of being engaged by the teeth of the fastener described herein.

Figure 2:
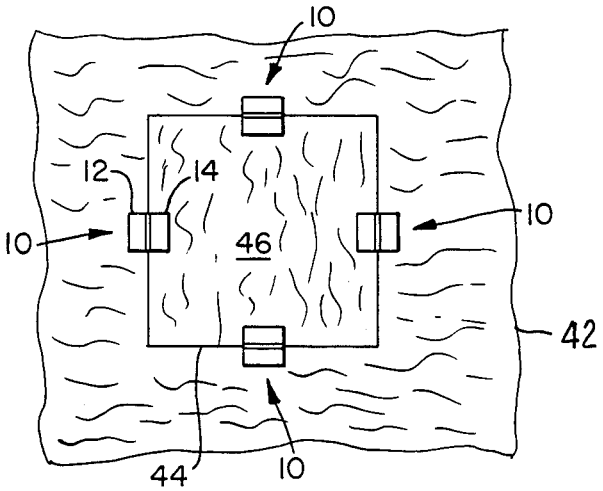
FIG. 2 is a plan view of a wall with an insert utilizing fasteners of the type shown in FIG. 1.
Figure 3:
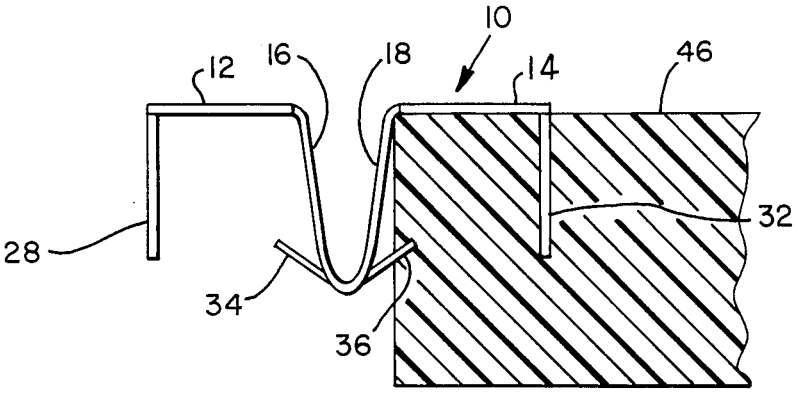
FIG. 3 is an edge view of a fastener mounted on an insert prior to mounting of the latter.

To illustrate how fastener 10 may be employed, reference is made to FIG. 2 where is shown a wall 42 of usual wallboard with a rectangular opening 44 where an insert 46 of similar material is to be placed, taped, spackled, and then painted. It will be noted that four fasteners 10 are employed. Each fastener 10 is first mounted on insert 46 as seen in FIG. 3 and then insert 46 is placed into opening 44 of wall 42, causing legs 16 and 18 of the V-section to compress and spikes or teeth 28 to be pushed into wall 42. Teeth 34 and 36 engage the side facing surfaces of wall 42 and insert 46 so that in effect insert 46 is locked in firmly within opening 44, thereby simplifying the subsequent taping of the joint which is formed. The use of taping and spackling will make the fasteners 10 not visible to the naked eye while at the same time rendering the whole area firmer than would be an insert without the use of fasteners.

Figure 4:
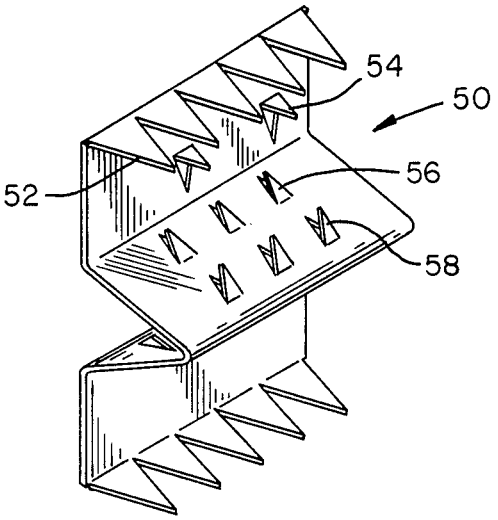
FIG. 4 is an isometric view of an alternative embodiment.

As seen in FIG. 4, fastener 50 embodying the principles of this invention can be provided with multiple rows of teeth such as teeth 52, 54 and 56, 58 on one side which may also be staggered. In addition, the flat segments or surfaces, such as 12 and 14 in FIG. 1 can have any other suitable shape and the width of the V-section can be either narrower or wider than flat segments 12 or 14, depending upon the application or the particular material of the wallboard and/or the insert.

It will be noted from FIG. 1 that the width of flat segments 12 and 14 extends beyond teeth 28 and 32 as well as legs 16 and 18. This spreads the contact area on wall 42 and section 46 while reducing the need for additional fastener material.

It is thus seen there has been provided a uniquely designed fastener useful in the filling in of openings in walls and the like.

While only certain preferred embodiments of the invention have been described it is understood that many variations are possible without departing from the principles of this invention as defined in the claims which follow.

What is claimed is:

1. A fastener for securing a section of wallboard fitted into an opening in a wall of wallboard construction comprising metal clip means having a pair of spaced flat surfaces substantially in the same plane as, and having teeth to penetrate, the adjacent exposed surfaces of said section of wallboard and said wall of wallboard when the former is inserted into said opening so that said spaced flat surfaces of said metal clip become flush with the surfaces of said section and will when said teeth fully penetrate said section and wall, V-shaped extension means comprising a pair of legs joined at the edges removed from said flat surfaces extending into the space between said section and wall, and teeth on the outside of and on both legs of said V-shaped extension directed toward said spaced flat surfaces so that when said clip is first mounted on said section of wallboard and the latter is then inserted into said opening in the wall of teeth on said clip will resist movement of said section once fully mounted in said opening flush with said wall, said spaced flat surfaces being flush against the surfaces of said wall and section simplifying the subsequent taping of the joint between said section and said wall on the exposed surfaces thereof.

2. The fastener of claim 1 in which the teeth extending from the flat surfaces of said clip are located along edges of said flat surfaces.

3. The fastener of claim 2 in which the V-shaped extension is resilient so that its compression during mounting of said clip will insure positive engagement of the teeth mounted on said extension with the adjacent portions of said section and wall.

4. The fastener of claim 3 in which said spaced flat surfaces extend beyond the teeth on said flat surfaces and said V-shaped extension thereby spreading the contact surface on said wall and section with a minimum of additional fastener material.

* * * * *